United States Patent [19]

Geschka

[11] Patent Number: 4,518,942

[45] Date of Patent: May 21, 1985

[54] ELECTRIC MACHINE, SUCH AS TRANSFORMER CHOKE, CONSTANT-VOLTAGE REGULATOR OR THE LIKE

[75] Inventor: Hugo-Werner Geschka, Düsseldorf, Fed. Rep. of Germany

[73] Assignee: E. Blum GmbH & Co., Vaihinsen/Enz, Fed. Rep. of Germany

[21] Appl. No.: 601,115

[22] Filed: Apr. 18, 1984

Related U.S. Application Data

[63] Continuation of Ser. No. 292,024, Aug. 11, 1981, abandoned, which is a continuation of Ser. No. 73,523, Sep. 7, 1979, abandoned.

[30] Foreign Application Priority Data

Sep. 8, 1978 [DE] Fed. Rep. of Germany ..... 2839114

[51] Int. Cl.[3] ..... H01F 27/26; H01F 41/02

[52] U.S. Cl. ..... 336/178; 29/606; 29/609; 336/210; 336/234

[58] Field of Search ..... 336/210, 212, 215, 214, 336/216, 217, 219, 234, 178; 310/217, 218; 29/605, 606, 607, 609

[56] References Cited

U.S. PATENT DOCUMENTS

| | | | |
|---|---|---|---|
| 454,090 | 6/1891 | Thomson | 336/210 |
| 581,873 | 5/1897 | Thomson | 336/217 |
| 1,406,245 | 2/1922 | Thordarson | 336/216 |
| 2,195,192 | 3/1940 | Schuller | 336/178 X |
| 2,293,951 | 8/1942 | Seastone et al. | 336/219 X |
| 2,425,622 | 8/1947 | Kronmillen | 336/215 X |
| 2,488,391 | 11/1949 | Ford et al. | 336/210 |
| 2,592,652 | 4/1952 | Buhrendorf | 336/178 |
| 2,699,532 | 1/1955 | Bussing | 336/178 X |
| 2,806,212 | 9/1957 | Kuhn | 336/212 X |
| 4,136,322 | 1/1979 | Maezima | 336/217 X |
| 4,140,987 | 2/1979 | Maezima | 336/217 X |

FOREIGN PATENT DOCUMENTS

| | | | |
|---|---|---|---|
| 20647 | of 1903 | United Kingdom | 336/210 |

*Primary Examiner*—Thomas J. Kozma
*Attorney, Agent, or Firm*—Peter K. Kontler

[57] ABSTRACT

Electric machine, such as a transformer, a choke or a constant-voltage regulator, having an iron core assemblable from a plurality of individual, substantially rectangular core parts, including legs and intermediate yoke parts, formed of mutually held-together laminate layers, and clamping means such as clamping straps or plates clampable into engagement with a corresponding clamping surface at outer contours of the leg core parts transversely to the laminate layers by clamping elements such as screws or rivets, includes means defining channel or tunnel-shaped recesses extending parallel to all of the mutually parallel laminate layers of all of the assemblable individual core parts and substantially perpendicularly to juxtaposed joint abutments of the respective individual core parts.

8 Claims, 1 Drawing Figure

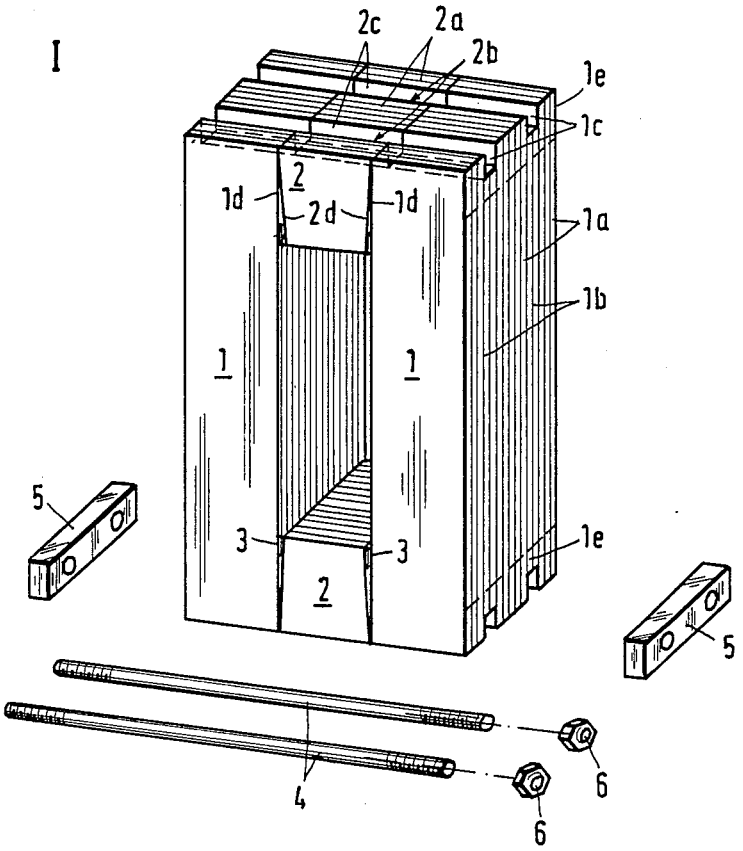
I
2c
2a
2b
1e
1c
2
1d
2d
1d
1a
1b
1
1
5
3
3
1e
2
5
4
6
6

ELECTRIC MACHINE, SUCH AS TRANSFORMER CHOKE, CONSTANT-VOLTAGE REGULATOR OR THE LIKE

This application is a continuation of application Ser. No. 292,024, now abandoned, filed Aug. 11, 1981, which is a continuation of application Ser. No. 73,523, now abandoned, filed Sept. 7, 1979.

The invention relates to electric machines such as transformers, chokes, constant-voltage regulators or the like, having an iron core assemblable from a plurality of individual, substantially rectangular core parts, including legs and intermediate yoke parts, formed of mutually held-together laminate layers, and clamping means, such as clamping straps, clamping plates or the like, clampable into engagement with surfaces corresponding clamping surface at outer contours of the leg core parts transversely to the laminate layers, by means of clamping elements such as screws, rivets or the like.

The parts of the iron core may be held together by clamping means such as screws or rivets, extending through bores formed in the core parts. Such bores can be formed only by chip-removing machining operations, which represents a considerable cost factor. Moreover, functional disadvantages can result from the chip-removing machining operation, since burr can be formed in the bores as well as at the joint abutments, producing electromagnetic short-circuits, high temperatures and low efficiency.

It is an object of the invention to provide an electric machine of the foregoing general type, in which these disadvantages are eliminated and to provide such an electric machine with an iron core which assures high efficiency, low operation temperature and automated production and, thereby, low costs.

With the foregoing and other objects in view there is provided, in accordance with the invention, an electric machine such as a transformer, a choke or a constant-voltage regulator, having an iron core assemblable from a plurality of individual, substantially rectangular core parts, including legs and intermediate yoke parts, formed of mutually held-together laminate layers, and clamping means such as clamping straps or plates clampable into engagement with a corresponding clamping surface at outer contours of the leg core parts transversely to the laminate layers by clamping elements such as screws or rivets, comprising means defining channel or tunnel-shaped recesses extending parallel to all of the mutually parallel laminate layers of all of the assemblable individual core parts and substantially perpendicularly to juxtaposed joint abutments of the respective individual core parts.

While these recesses can also be formed by chip-removing or material-removing machining operations, whereby formation of burrs and, thereby, magnetic short-circuits can largely be avoided, it is particularly advantageous, in accordance with another feature of the invention, to provide such recesses free of metal cuttings or chips. This can be done in a particularly simple manner, in accordance with a further feature of the invention, by joining together several laminate layers of varying heights or levels. If several clamping means and, therefore, several channel or tunnel-shaped cutouts or recesses are employed, it is advantageous, in accordance with an added feature of the invention, to insert a number of shorter laminate layers corresponding to the height and width of the channel between a corresponding number of longer laminate layers, and to then press the individual sheetmetal laminations together, for example, under the action of heat.

Due to the fact that the laminate layers of the legs and of the intermediate yoke parts are then parallel to one another, the magnetic transitions between all of the laminate layers are free of any difficulty. By the corresponding construction of the channel or tunnel-shaped slots, assurance is provided that metallic bridges cannot be formed between the individual laminate layers of a core part. Furthermore, a very simple and inexpensive assembly of such an electric machine is afforded, since the clamping means are merely required to be placed in the channel or tunnel-shaped slots. The recesses or channels or tunnels are advantageously provided with such a height or depth that they are located in vicinity of the magnetically most inactive zones of the electric machine.

In accordance with the invention, there is also provided an electric machine such as a transformer, a choke or a constant-voltage regulator, having an iron core assemblable from a plurality of individual, substantially rectangular core parts, including legs and intermediate yoke parts, formed of mutually held-together laminate layers, and clamping means such as clamping straps or plates clampable into engagement with a corresponding clamping surface at outer contours of the leg core parts transversely to the laminate layers by clamping elements such as screws or rivets, comprising a coil mounted on the respective legs, the legs being formed at both ends thereof with at least one channel or tunnel-shaped recess extending parallel to respective planes of the laminate layers and substantially perpendicularly to juxtaposed joint abutments of the respective legs and intermediate yoke parts having a varying magnetic reluctance with a minimum value in a region thereof having paths of magnetic lines of force of maximal length, the individual laminate layers of the legs and of the intermediate yoke parts being mutually parallel, the intermediate yoke parts also having at least one channel or tunnel-shaped recess extending parallel to respective planes of the laminate layers thereof and also extending substantially perpendicularly to the juxtaposed joint abutments, the clamping elements being received in the recesses formed in the legs and the intermediate yoke parts, and the clamping surfaces as well as the joint abutments having material-removed, planed surfaces free of possible material bridges.

In accordance with a concomitant feature of the invention, the channel or tunnel-shaped recesses are located in regions of the legs and the intermediate yoke parts having a minimal loading of magnetic lines of force thereat.

Other features which are considered as characteristic for the invention are set forth in the appended claims.

Although the invention is illustrated and described herein as embodied in electric machine such as transformer, choke, constant-voltage regulator or the like, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a perspective and partly exploded view of an electric machine constructed in accordance with the invention.

Referring now to the drawing, there is shown an iron core for an electric machine assembled from leg core parts 1 and yoke parts 2 disposed intermediate thereto. The leg core parts 1, on which the non-illustrated coils of an electric machine are placed, are formed of individual sheetmetal laminations 1*a* and 1*b* of different lengths. The shorter laminations 1*b*, as shown in the FIGURE of the drawing, are sandwiched between the longer laminations 1*a*. Channel or tunnel-shaped recesses 1*c* extending parallel to the layers of sheetmetal laminations 1*a* and 1*b* are thus formed.

The intermediate yoke parts 2 are likewise formed of a multiplicity of individual laminations, where again several layers of longer sheetmetal laminations 2*a* are provided on both sides of several layers of shorter sheetmetal laminations 2*b*, so that also in the intermediate yoke parts 2, outwardly opening channel or tunnel-shaped openings 2*c* are produced, which are parallel to the layers of the sheetmetal laminations, and wherein all layers of laminations of all core parts are again parallel to one another.

Between the core parts are joint abutments 1*d* and 2*d*, which are so formed to offer a varying magnetic reluctance to the magnetic lines of force and, in fact, in this case by a varying spacing therebetween in a manner that the smallest spacing or intermediate distance is provided in the region of the longest path of the lines of force.

To keep the varying spacing constant, spacers 3 are provided between the joint abutments 1*d* and 2*d*.

After non-illustrated coils are slipped onto the legs 2, such an electric machine is assembled by inserting clamping elements in the form of screws 4 from above as well as from below, as viewed in the FIGURE, into the channel or tunnel-shaped recesses 1*c* and 2*c*, respectively, and the electric machine is assembled and clamped together by tightening the nuts 6, after clamping means i.e. clamping strips or straps 5, have been slipped onto those screws. The clamping straps 5 then engage the clamping surfaces 1*e*. Advantageously, the clamping surfaces 1*e* as well as the joint abutments 1*d* and 2*d* are planed or smoothed by an operation such as grinding and are freed of previously formed material bridges by subsequent processing, for example, by brushing, ball or sand-blasting, lapping or etching.

There is claimed:

1. An iron core for use in electric machines such as transformers, chokes, magnetic constant voltage regulators and the like, comprising a plurality of substantially rectangular first and second core parts, each of said core parts comprising a plurality of parallel metallic laminations and said first and second core parts together defining joint abutments, the planes of the laminations of said core parts being parallel to the planes of the laminations of said second core parts, said first core parts having outer contours provided with clamping surfaces and the laminations of each of said first core parts and each of said second core parts including groups of laminations defining external channels extending and being open all the way between the clamping surfaces of said first core parts substantially transversely of said joint abutments and in substantial parallelism with the planes of said laminations, said groups of laminations having surfaces bounding the respective channels and being devoid of metal cuttings; and means for urging said first core parts against said second core parts in the regions of said joint abutments, including clamping members adjacent to said clamping surfaces and elongated clamping elements received in said channels and arranged to urge said clamping members against the respective clamping surfaces.

2. The iron core of claim 1, wherein the laminations of each of said core parts are coherent and said first core parts have end portions which flank said second core parts, said channels including portions provided in the end portions of said first core parts.

3. The iron core of claim 1, wherein said clamping surfaces and said joint abutments are smoothed, as by grinding, so that they are devoid of material bridges between neighboring laminations.

4. The iron core of claim 1, wherein said first core parts and said second core parts define, in the region of each of said joint abutments, relatively short first paths and relatively long second paths for magnetic force lines and the magnetic reluctance of said joint abutments is more pronounced in the regions of said shorter paths and less pronounced in the regions of said longer paths.

5. A method of assembling an iron core for use in electric machines such as transformers, chokes, magnetic constant voltage regulators and the like from core parts which include first and second core parts and wherein the first core parts have outer contours with clamping surfaces, comprising the steps of assembling each core part of several groups of parallel metallic laminations and staggering the groups of laminations so that the thus staggered groups form exposed channels and the channels of the first core parts extend to the respective clamping surfaces; placing the second core parts between the first core parts so that all of the laminations are parallel to one another, that the channels of the second core parts register with the channels of the first core parts and the resulting composite channels extend all the way between the clamping surfaces of the first core parts, that the first and second core parts therebetween define joint abutments and that the clamping surfaces of the first core parts are disposed at the opposite sides of the resulting core; and biasing the first core parts against the second core parts in the regions of the joint abutments, including placing clamping members adjacent to the clamping surfaces and urging the clamping members against the respective clamping surfaces including inserting elongated clamping members into the channels of the core parts and connecting the clamping elements with pairs of clamping members.

6. The method of claim 5, further comprising the step of placing a winding around at least one of the first core parts.

7. The method of claim 5, further comprising the step of smoothing, such as by grinding, the clamping surfaces of the first core parts and those portions of the core parts which define the joint abutments so that the joint abutments and the clamping surfaces are free of material bridges between the neighboring laminations.

8. The method of claim 5, wherein the depth of the channels is less than half the width of the laminations.

* * * * *